US011493195B1

(12) United States Patent
Katz et al.

(10) Patent No.: US 11,493,195 B1
(45) Date of Patent: Nov. 8, 2022

(54) FLOATING SUBSURFACE ILLUMINATION SYSTEM

(71) Applicants: David Katz, Arcata, CA (US); William Ramsdell, La Vegas, NV (US)

(72) Inventors: David Katz, Arcata, CA (US); William Ramsdell, La Vegas, NV (US)

( * ) Notice: Subject to any disclaimer, the term of this patent is extended or adjusted under 35 U.S.C. 154(b) by 0 days.

(21) Appl. No.: 17/667,956

(22) Filed: Feb. 9, 2022

(51) Int. Cl.

| | |
|---|---|
| ***F21V 23/02*** | (2006.01) |
| ***F21V 31/00*** | (2006.01) |
| ***F21L 4/08*** | (2006.01) |
| ***F21V 21/08*** | (2006.01) |
| ***F21W 131/401*** | (2006.01) |
| ***F21Y 115/10*** | (2016.01) |

(52) U.S. Cl.
CPC ..... *F21V 23/023* (2013.01); *F21L 4/08* (2013.01); *F21V 21/08* (2013.01); *F21V 31/005* (2013.01); *F21W 2131/401* (2013.01); *F21Y 2115/10* (2016.08)

(58) Field of Classification Search
CPC ..... F21V 23/023; F21V 21/08; F21V 31/005; F21L 4/08; F21W 2131/401; F21Y 2115/10
See application file for complete search history.

(56) References Cited

U.S. PATENT DOCUMENTS

| | | | | |
|---|---|---|---|---|
| 4,088,880 | A * | 5/1978 | Walsh | F21S 9/02 239/18 |
| 9,772,288 | B1 * | 9/2017 | Lapota | G01N 21/645 |
| 10,706,752 | B2 * | 7/2020 | Greenfield | E01F 9/688 |
| 2006/0033674 | A1 * | 2/2006 | Essig, Jr. | F24S 23/715 343/915 |
| 2006/0092630 | A1 * | 5/2006 | Kennedy | F21S 8/00 362/157 |
| 2011/0240757 | A1 * | 10/2011 | Selk | B05B 17/08 239/18 |
| 2012/0176782 | A1 * | 7/2012 | VanderSchuit | F21S 10/007 362/184 |
| 2012/0190256 | A1 * | 7/2012 | Martzall | B63B 22/166 441/16 |
| 2014/0071681 | A1 * | 3/2014 | Ghafoori | F21V 23/0464 362/249.14 |
| 2014/0203184 | A1 * | 7/2014 | Purdy | G01N 33/18 250/393 |

* cited by examiner

*Primary Examiner* — Tsion Tumebo
(74) *Attorney, Agent, or Firm* — Robert Brownstein

(57) ABSTRACT

The invention is a floating subsurface illumination system comprising a leak-proof enclosure, DC electric energy subsystem, LED light source subsystem, translucent diffuser, tethering eyelet, switch and charging port.

4 Claims, 3 Drawing Sheets

FLOATING SUBSURFACE ILLUMINATION SYSTEM

TECHNICAL FIELD

This invention is an illumination system for subsurface illumination in pools of liquid.

BACKGROUND OF THE INVENTION

There are copious reasons for having a floating subsurface illumination system. During hours of darkness, if an object needs to be retrieved from the floor of a pool, lake, river, or bay, one needs an light source that can be manipulated on the surface while providing illumination below the surface. Another application involves using a floating subsurface illumination system to attract small sea-life to the light source which in turn attracts larger sea-life that feed on the smaller ones.

Where a floating subsurface illumination system is used off shore, it needs to have sufficient self-contained energy source to provide illumination for the required use duration. A rechargeable energy source that could be replenished after use would reduce operation costs by reducing the need to replace energy sources.

By using a light source, such as light-emitting diode (LED) sources, one is able to have a favorable light intensity per watt characteristic that may reduce the size of the requisite energy source and make its recharging time shorter.

Clearly, a floating subsurface illumination system containing electrical subsystems must ensure that no water gets inside. Furthermore, the system needs to be stable so that turbulence will not cause it to capsize.

BRIEF SUMMARY OF THE INVENTION

The invention herein disclosed and claimed is a floating subsurface illumination system comprising a leak-proof enclosure, an internal rechargeable DC electric source, an internal LED light source, a translucent diffuser portion of the enclosure that allows light to exit, and an interface that allows the internal DC source to be recharged.

The leak-proof enclosure provides more than just waterproof subsystem containment. It comprises a wider upper portion that floats above the surface and a narrower lower portion that protrudes below the surface. By choosing relative upper and lower portion lengths and diameters, it is possible to tailor a system to different light intensity, battery life, and stability requirements. By the physical placement of the internal subsystems, one may move the system's center of gravity near the lowest point of the narrower lower portion of the enclosure. By so doing, it increases the stability of the downward vertical light projection even where surface conditions are turbulent.

BRIEF DESCRIPTIONS OF THE DRAWINGS

DETAILED DESCRIPTION OF THE INVENTION

The invention herein disclosed and claimed is a floating subsurface illumination system. By using efficient LED light sources, and DC electrical energy sources, the system can provide hours of light, during darkness, thereby illuminating areas below the surface of a pool of liquid.

Clearly, a floating subsurface illumination system having electrical subsystems must provide leak-proof containment of those subsystems. Furthermore, the containment should play more than a role of containment and should provide stability such that surface turbulence does not cause significant directional displacement of the light energy.

Whereas the DC electrical energy source could be non-rechargeable and replaced when charge is depleted, it is more convenient and cost-efficient to use rechargeable DC electrical sources.

In addition, it is more efficient to use LED light sources versus other technologies because one achieves a good balance of light intensity per watt. The light sources are typically smaller than other technologies, and the DC electrical sources may be smaller, too, because they need not have as much capacity.

The system disclosed and claimed can provide general purpose subsurface illumination. The dimensions of the enclosure, capacity of the DC energy source, and intensity of the LED source can all be selected to meet application requirements such as maximum illumination depth, maximum illumination time, and the like.

Figure 1:
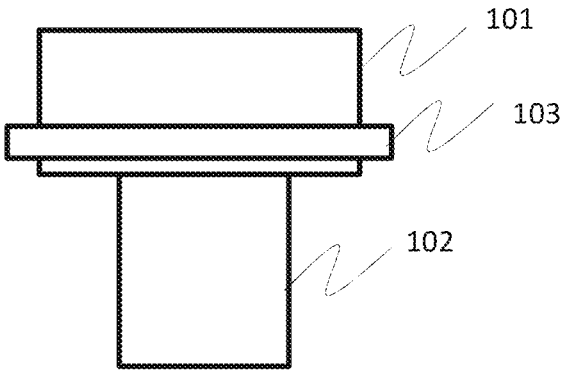
FIG. 1 depicts a side view of an exemplary embodiment of the system.

As shown in FIG. 1, an exemplary embodiment of the system, leak-proof containment is provided by an enclosure comprising an upper portion (101) and lower portion (102). As shown, the upper portion has a larger diameter which provides greater area and thereby greater positional stability. A flotation ring (103) is affixed to the upper portion to provide buoyancy and additional positional stability. FIG. 1 is a side view.

Figure 2:
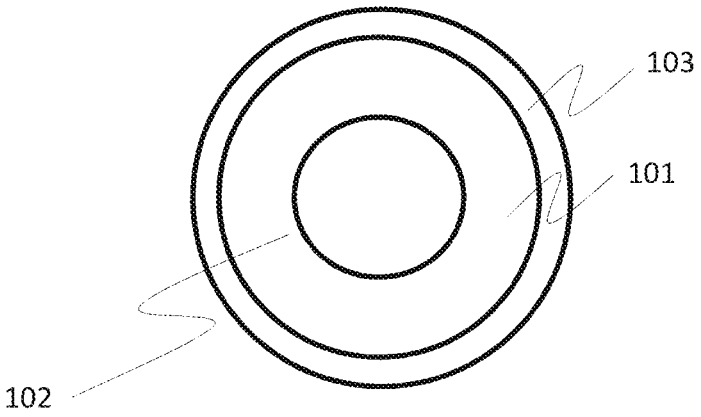
FIG. 2 depicts a bottom view of the exemplary embodiment of FIG. 1.

FIG. 2 is a bottom view of this exemplary embodiment.

Figure 3:
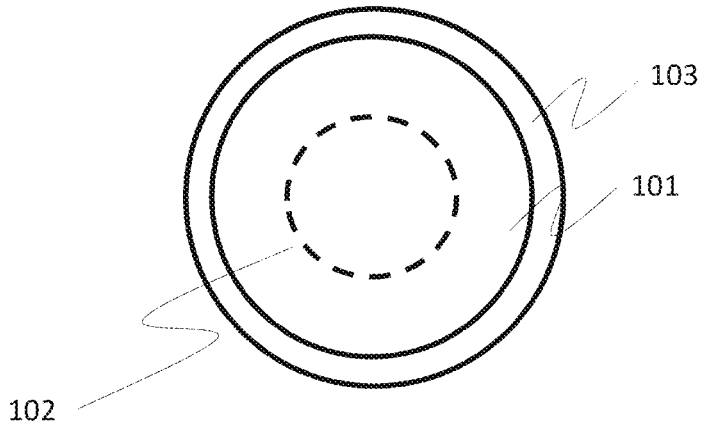
FIG. 3 depicts a top view of the exemplary embodiment of FIG. 1.

FIG. 3 is a top view of this exemplary embodiment.

Figure 4:
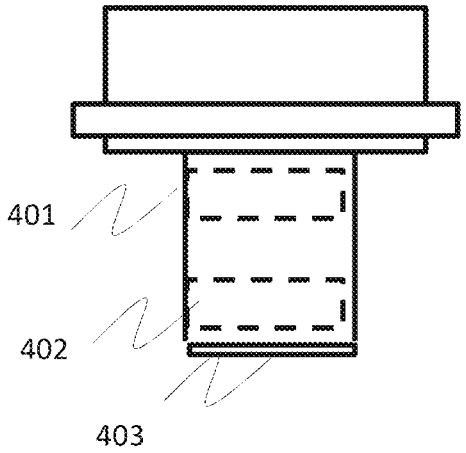
FIG. 4 depicts a DC electrical source subsystem, LED light source subsystem and translucent diffuser in the exemplary embodiment of FIG. 1.

FIG. 4 illustrates one example of the placement of a DC energy source (401) and LED light source (402). In addition, the face of the lower portion of the leak-proof enclosure is a translucent diffuser through which the LED light energy exits the enclosure causing light to be transmitted vertically downward as well as horizontally to the side.

Figure 5:
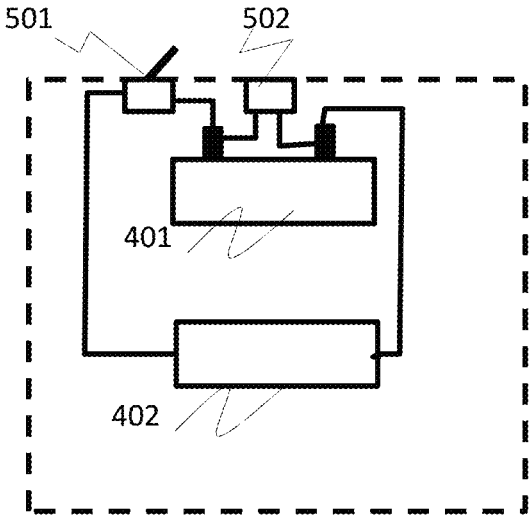
FIG. 5 depicts the DC electrical source subsystem, LED light source subsystem, a switch and charging interface.

FIG. 5 illustrates the interconnection of the DC energy source (401), the LED light source (402), a switch (501) and charging interface (502).

Figure 6:
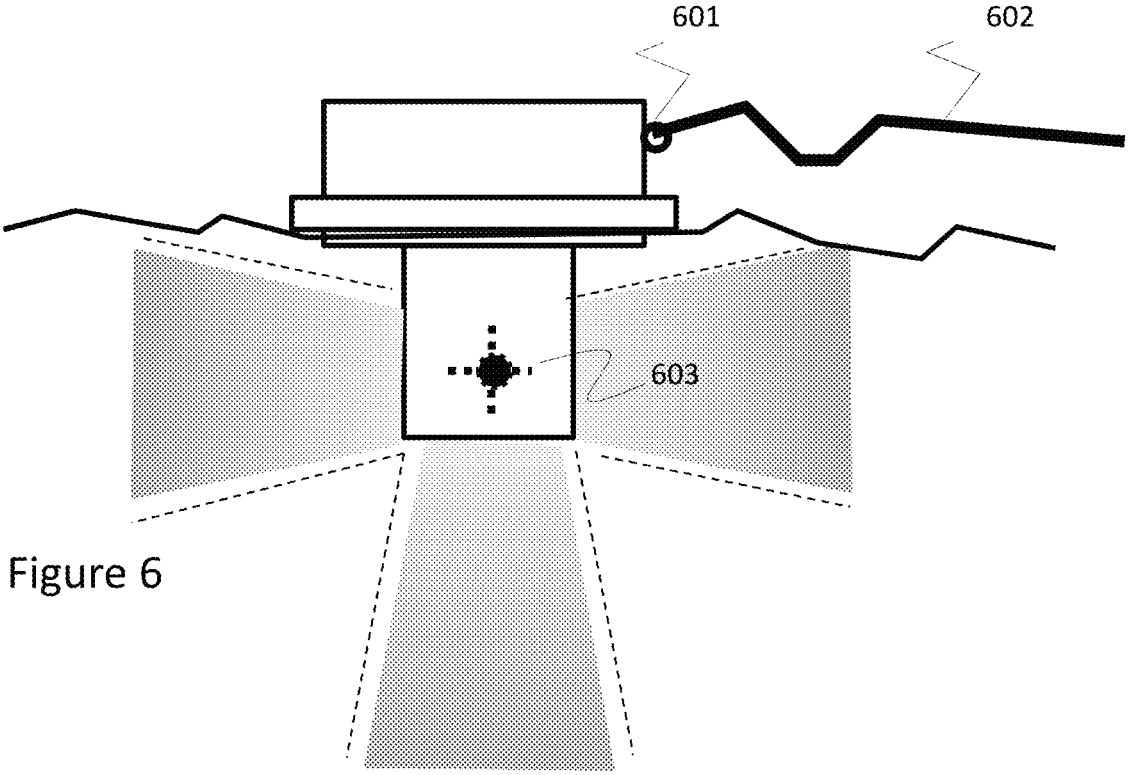
FIG. 6 depicts the exemplary embodiment deployed such that it floats on the surface, with the upper portion of the enclosure providing a wider area for stability, and the center of gravity near the lowest position to provide additional stability.

FIG. 6 provides an exemplary view of the system floating on the surface with an external eyelet (601) to which a tether (602) is attached, and where by placement of the internal subsystems, the center of gravity (603) is near the lowest point of the narrow enclosure portion.

The figures are exemplary. Here the portions are cylindrical shaped but need not be. They could also be polygonal. The recharging could be provided by a subsystem connected to utility lines, or to a subsystem exploiting solar electric energy. The switch and charging interface are shown on the top of the enclosure, when floating, but need not be so located. The figures should therefore not be viewed as limiting the scope of the invention to these exemplary specifics.

What is claimed is:

1. A system comprising:

a leak-proof containment structure operative to sit above a water surface;

a buoyant ring operative to prevent submergence of said containment structure below said water surface;

an LED light source;

a DC electric power source;

said buoyant ring is located externally to said leak-proof containment structure;

said buoyant ring is securely affixed to said leak-proof containment structure;

said leak-proof containment structure has a lower translucent portion that extends below the surface and is operative to convey light from inside said leak-proof containment structure both downward and to the sides of said leak-proof containment structure;

said lower translucent portion has a smaller horizontal dimension than said leak-proof containment structure operative to sit above said water surface;

said leak-proof containment structure contains essentially said LED light source and said DC electric power source;

said leak-proof containment structure with said LED light source and said DC electric power source contained inside, and said buoyant ring securely affixed outside, has a center of gravity such that said translucent portion is below the surface and positioned to transmit light vertically downward and horizontally sideward when said leak-proof container is floating on said water surface; and said leak-proof containment structure has an external eyelet structure operative to be tied to a tether to prevent said leak-proof containment structure from floating freely.

2. A claim as in claim 1 further comprising:

said leak-proof container has a waterproof port with an electrical connector;

said electrical connector provide an interface to an electric charging subsystem; and said electric charging subsystem conveys charging power to said DC electric power source when interfaced to said electrical connector.

3. A claim as in claim 2 further comprising:

said electric charging subsystem uses utility power.

4. A claim as in claim 2 further comprising:

said electric charging subsystem uses solar electric power.

* * * * *